US012693100B2

(12) United States Patent
Nguyen

(10) Patent No.: US 12,693,100 B2
(45) Date of Patent: Jul. 28, 2026

(54) AIRSOFT PELLET COLLECTOR

(71) Applicant: Trinh A.H. Nguyen, Houston, TX (US)

(72) Inventor: Trinh A.H. Nguyen, Houston, TX (US)

( * ) Notice: Subject to any disclaimer, the term of this patent is extended or adjusted under 35 U.S.C. 154(b) by 466 days.

(21) Appl. No.: 18/491,067

(22) Filed: Oct. 20, 2023

(65) Prior Publication Data

US 2025/0130024 A1 Apr. 24, 2025

(51) Int. Cl.
*F41J 13/02* (2009.01)
*F41J 5/24* (2006.01)

(52) U.S. Cl.
CPC *F41J 13/02* (2013.01); *F41J 5/24* (2013.01)

(58) Field of Classification Search
CPC ..... F41J 13/00–02
See application file for complete search history.

(56) References Cited

U.S. PATENT DOCUMENTS 6,311,980 B1 * 11/2001 Sovine ..... F41J 13/00 273/410
8,403,329 B2 3/2013 Krickovic

FOREIGN PATENT DOCUMENTS

DE DD-158138 A1 * 12/1982 ..... F41J 13/00

OTHER PUBLICATIONS

Machine translation of DD158138 (Year: 1981).*
"A new pellet trap", A new pellet trap, blog uploaded on Nov. 9, 2021 by Tom Gaylord https://www.pyramydair.com/blog/2021/12/a-new-pellet-trap/ retrieved from web Mar. 21, 2024.
Guyuyii Portable BB Gun Targets with BB Catcher—Foldable, Easy Setup Design Airsoft Target with 1060PCS Shooting Targets for Efficient Training, IndoorOutdoor Practice https://www.amazon.com/AirSoft-Shooting-Reusable-Heavy-Duty-Training/dp/B00UVC47EW/ref=sr_1_6?crid=3SH66COCVVP2D&dib=eyJ2IjoiMSJ9.6JCx9LrePDusYjJLI36mB98xCJIJ74rqCkV5vcWmfyWkNxxOq0mNNf1M781SvD2iF36wk3TTGZJBL-.
Pellet Trap, BB Trap Target with 100 Papers Target Wall-Mounted for Airsoft Air Rifles Air Gun Indoor Outdoor Shooting Training https://www.amazon.com/COSMOING-Wall-Mounted-Airsoft-Shooting-Training/dp/B08SBY6Z6L/ref=sr_1_5?crid=3F679K97Z95A3&dib=eyJ2IjoiMSJ9.Owqi2fhuZQYWfIGSUOPCmR_nqdJRJKOIYG_OCSZ325Zh9yxQqxGA-rkPROiaEXSSHcAAedVOioMQgPLLaMSkJIc_hGkQBTauk-TWlgbjuZ-.
Champion 22 Rimfire Bullet Trap https://www.sportsmans.com/shooting-gear-gun-supplies/targets/shooting-targets-stands/champion-22-rimfire-bullet-trap/p/305819 retrieved from web Mar. 21, 2024.
Gamo Cone Pellet Trap https://www.gamo.com/en/gamo-catchpellet/ retrieved from web Mar. 21, 2024.
Yale Cone Pellet Trap https://neonsales.co.za/products/yale-cone-pellet-traps retrieved from web Mar. 21, 2024.
Top 10 Best Pellet Trap of 2024 https://top10best.how/pellet-trap retrieved from web Mar. 21, 2024.

* cited by examiner

*Primary Examiner* — Brian O Peters
(74) *Attorney, Agent, or Firm* — NGUYEN TARBET IP LAW

(57) ABSTRACT

An airsoft pellet receptacle device. The device may comprise a hollow body having a tapered helical shape. The hollow body may comprise a first opening at a first end of the hollow body, and a second opening at a second end of the hollow body. A diameter of the hollow body may decrease from the first end to the second end. The device may further comprise a base component comprising a pellet inlet, a collection chamber, and a hollow path within the base component connecting the pellet inlet to the collection chamber. In some embodiments, the second end of the hollow body may be coupled to the pellet inlet of the base component. Pellets shot into the first opening may travel down the length of the hollow body and through the pellet inlet into the collection chamber for retrieval.

18 Claims, 9 Drawing Sheets

2)

AIRSOFT PELLET COLLECTOR

FIELD OF THE INVENTION

The present invention is directed to an airsoft pellet receptacle device for optimally slowing and collecting airsoft pellets shot into its opening.

BACKGROUND OF THE INVENTION

Airguns, typically known as airsoft guns, are commonly shot at targets paired to collection devices. These prior target/collection devices typically comprise a penetrable target with a design, and a hollow structure behind the target for slowing down and guiding the pellets into a chamber where they can be easily collected. However, it is a challenge to design such a hollow structure that is able to efficiently slow down and guide the pellets safely. A hollow structure with a hard material and an inefficient shape could result in the pellets ricocheting back, while simply using a softer material could result in the pellets getting lodged in the material or penetrating the hollow body entirely, endangering people behind the device. Thus, there exists a present need for an air pellet target and collection device capable of optimally slowing and guiding an air pellet to a collection chamber.

BRIEF SUMMARY OF THE INVENTION

It is an objective of the present invention to provide devices that allow for an airsoft pellet receptacle device for optimally slowing and collecting airsoft pellets shot into its opening, as specified in the independent claims. Embodiments of the invention are given in the dependent claims. Embodiments of the present invention can be freely combined with each other if they are not mutually exclusive.

The present invention features an airsoft pellet receptacle device. In some embodiments, the device may comprise a hollow body having a tapered helical shape. The hollow body may comprise a first opening at a first end of the hollow body, and a second opening at a second end of the hollow body. In some embodiments, a diameter of the hollow body may decrease from the first end to the second end. The device may further comprise a base component comprising a pellet inlet, a collection chamber, and a hollow path within the base component connecting the pellet inlet to the collection chamber. In some embodiments, the second end of the hollow body may be coupled to the pellet inlet of the base component. Pellets shot into the first opening may travel down the length of the hollow body and through the pellet inlet into the collection chamber for retrieval.

In some embodiments, the device may further comprise a penetrable target disposed at the first end of the hollow body. In some embodiments, the penetrable target may fully cover the first opening. The penetrable target may comprise a sheet of material with a design (i.e. a bullseye). In some embodiments, the device may further comprise one or more motion sensors disposed at the first end of the hollow body, behind the penetrable target. In some embodiments, the device may further comprise one or more light-emitting diodes (LEDs) disposed on a surface of the hollow body, configured to emit light, communicatively coupled to the one or more motion sensors. Triggering the one or more motion sensors may cause the one or more LEDs to activate. In some embodiments, the device may further comprise one or more speakers disposed on a surface of the hollow body, configured to emit sound, communicatively coupled to the one or more motion sensors. Triggering the one or more motion sensors may cause the one or more speakers to activate. In some embodiments, the hollow body may be magnetized by one or more magnets.

One of the unique and inventive technical features of the present invention is the implementation of a helical shape for catching airsoft pellets shot into its opening. Without wishing to limit the invention to any theory or mechanism, it is believed that the technical feature of the present invention advantageously provides for optimal slowing of air pellets from their maximum speed to stopping without the risk of ricocheting or penetrating the structure, allowing for safe guidance of the pellets to a collection chamber. None of the presently known prior references or work has the unique inventive technical feature of the present invention.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

BRIEF DESCRIPTION OF THE SEVERAL VIEWS OF THE DRAWING(S)

The features and advantages of the present invention will become apparent from a consideration of the following detailed description presented in connection with the accompanying drawings in which.

FIGS. 4-7 show a plurality of graphs and examples of the math behind the Pythagorean Spiral implemented in the present invention. The general concept behind the Spiral is a series of right triangles specifically configured so that the hypotenuse of the first right triangle becomes a leg of the next right triangle. To find the lengths of the sides of the triangles that make up the spiral, triangles are required to complete one revolution in the spiral. After this first revolution, the triangles will begin to overlap.

Figure 1:
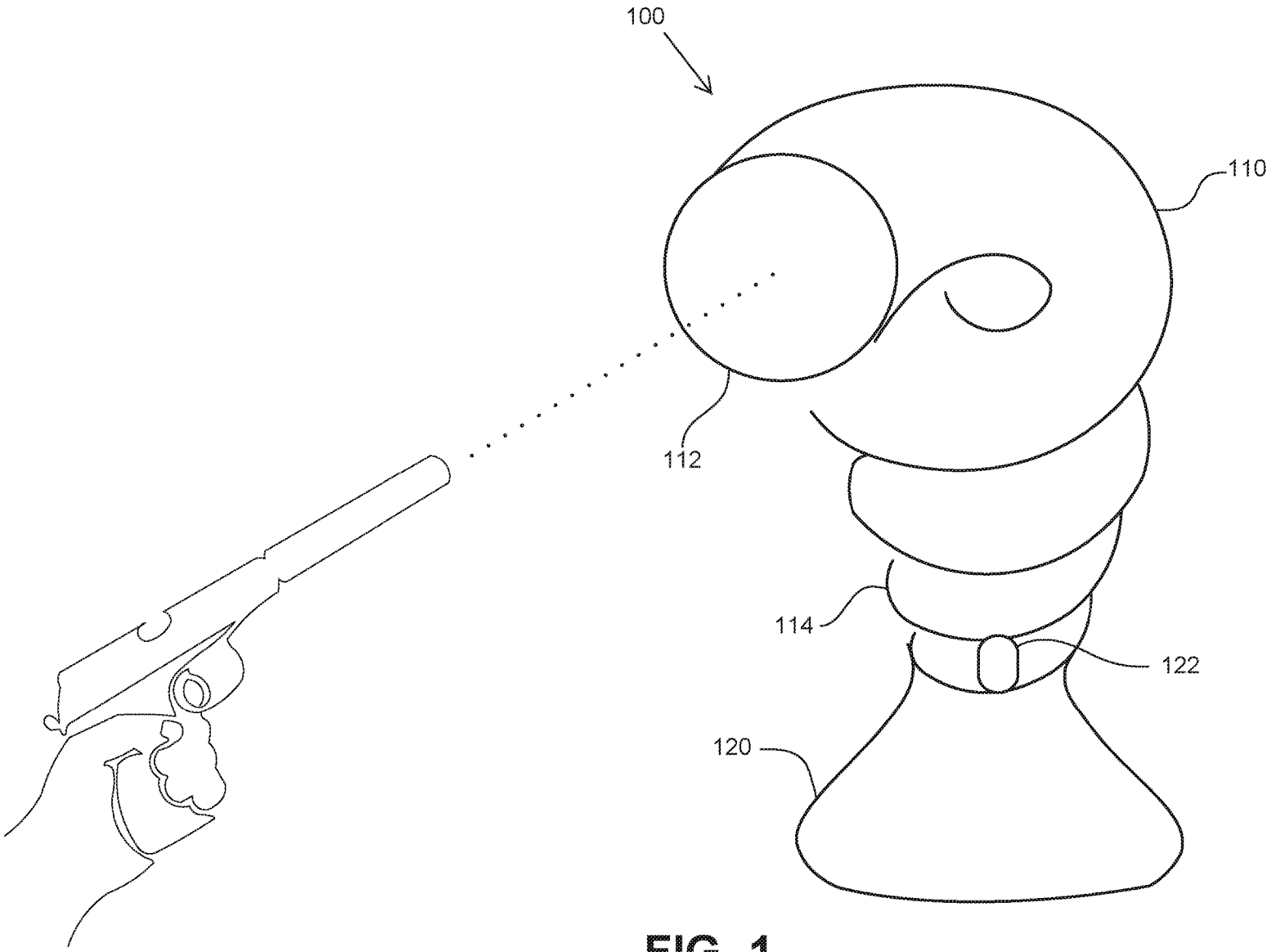
FIG. 1 shows a perspective view of the air pellet receptacle of the present invention.
Figure 2:
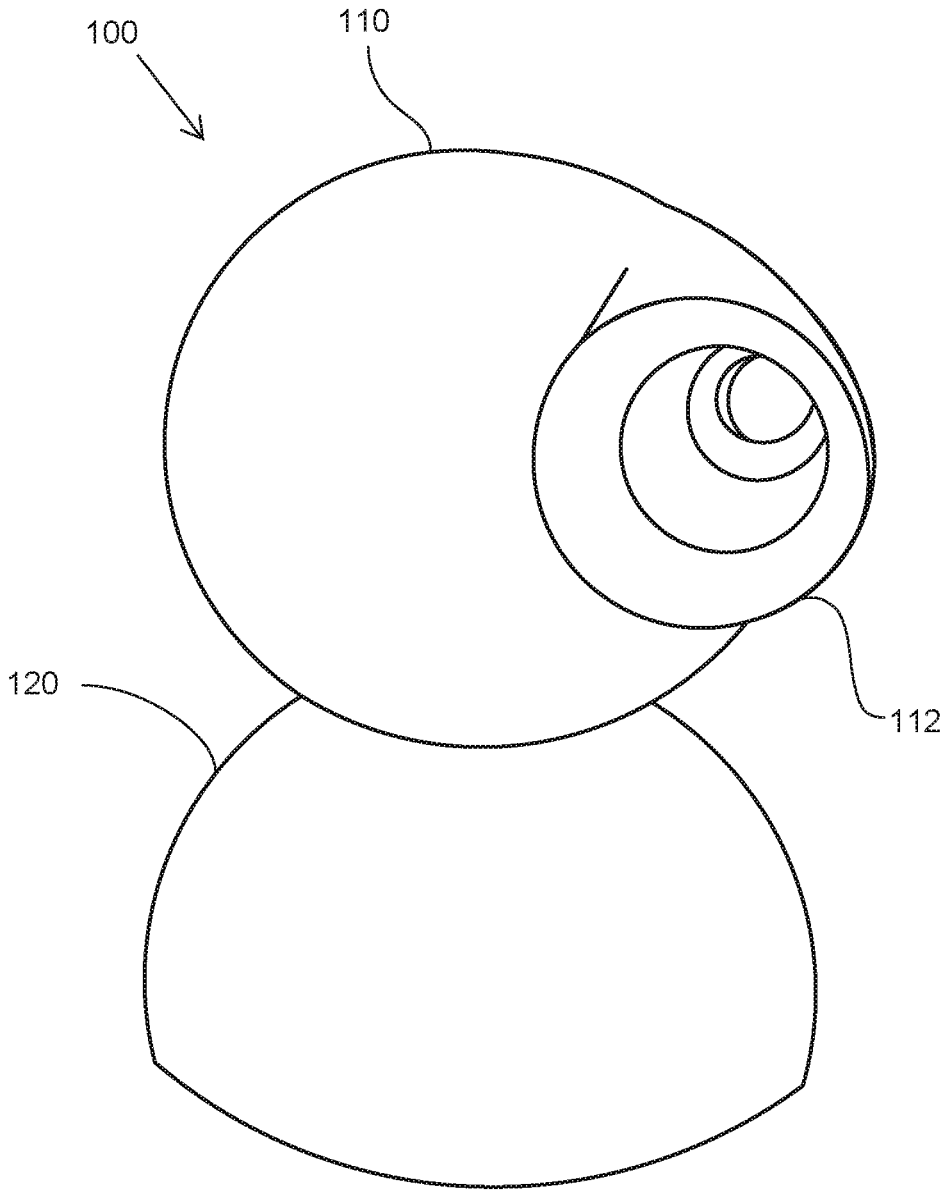
FIG. 2 shows an alternate perspective view of the air pellet receptacle of the present invention having a most effective vector for slowing incoming air pellets. Some embodiments of the present invention may additionally be adjustable through the use of magnetic coupling of components.
Figure 3:
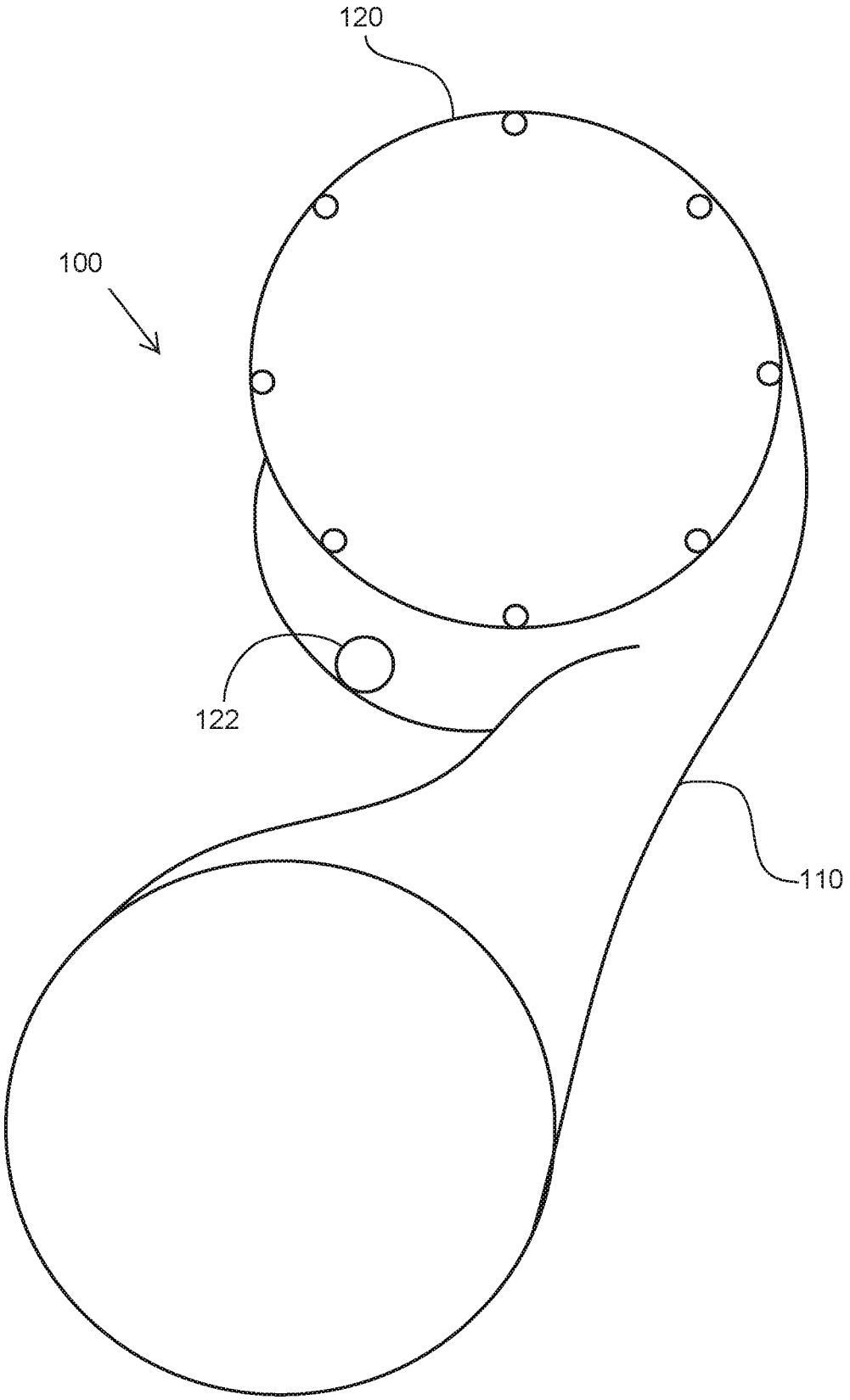
FIG. 3 shows a top view of the air pellet receptacle of the present invention.
Figure 4:
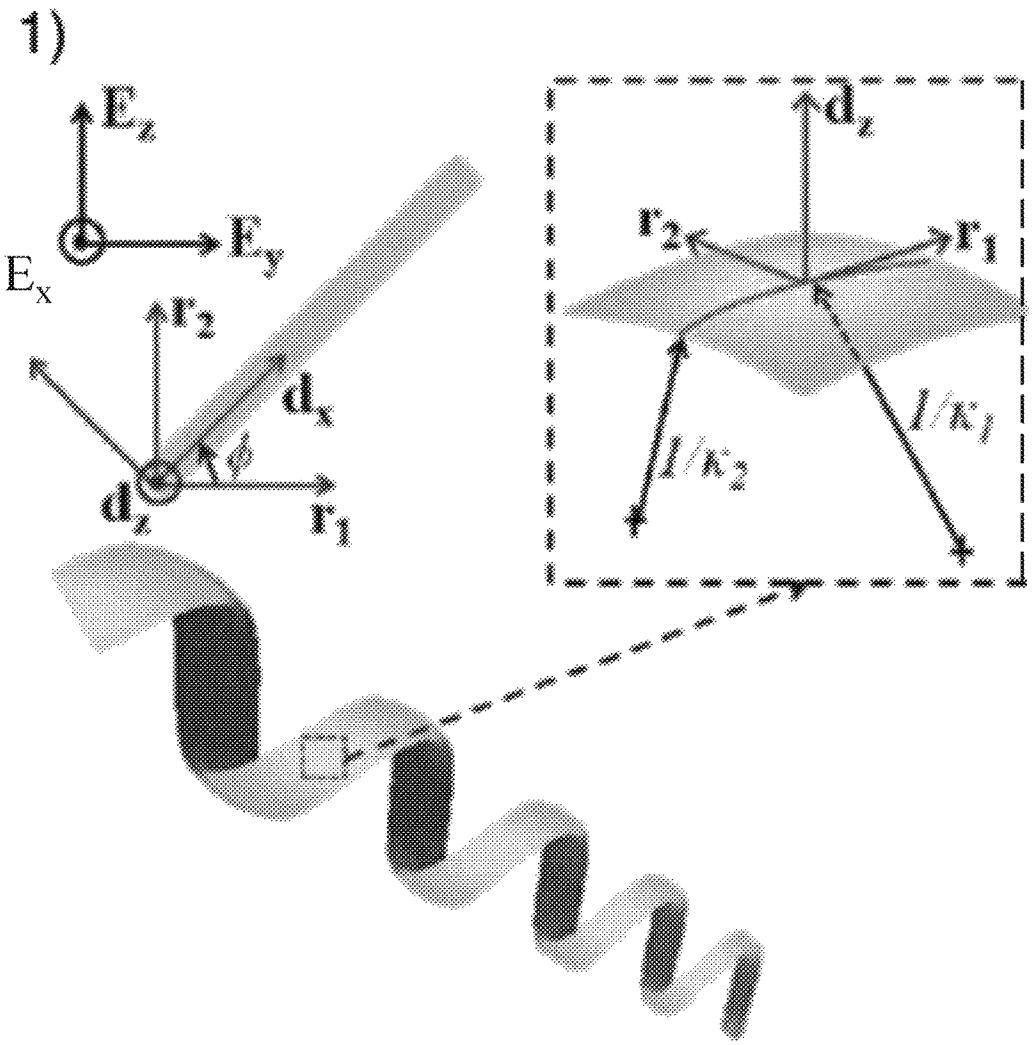
Figure 5:
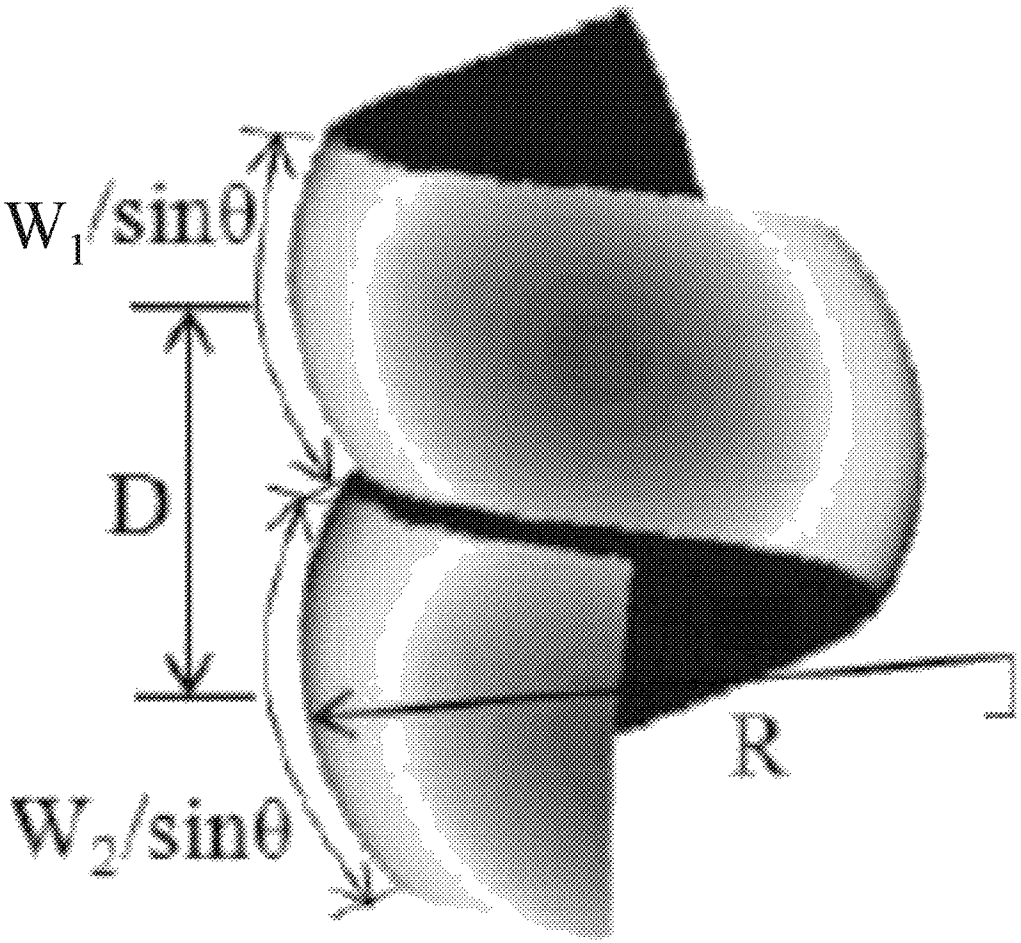
Figure 6:
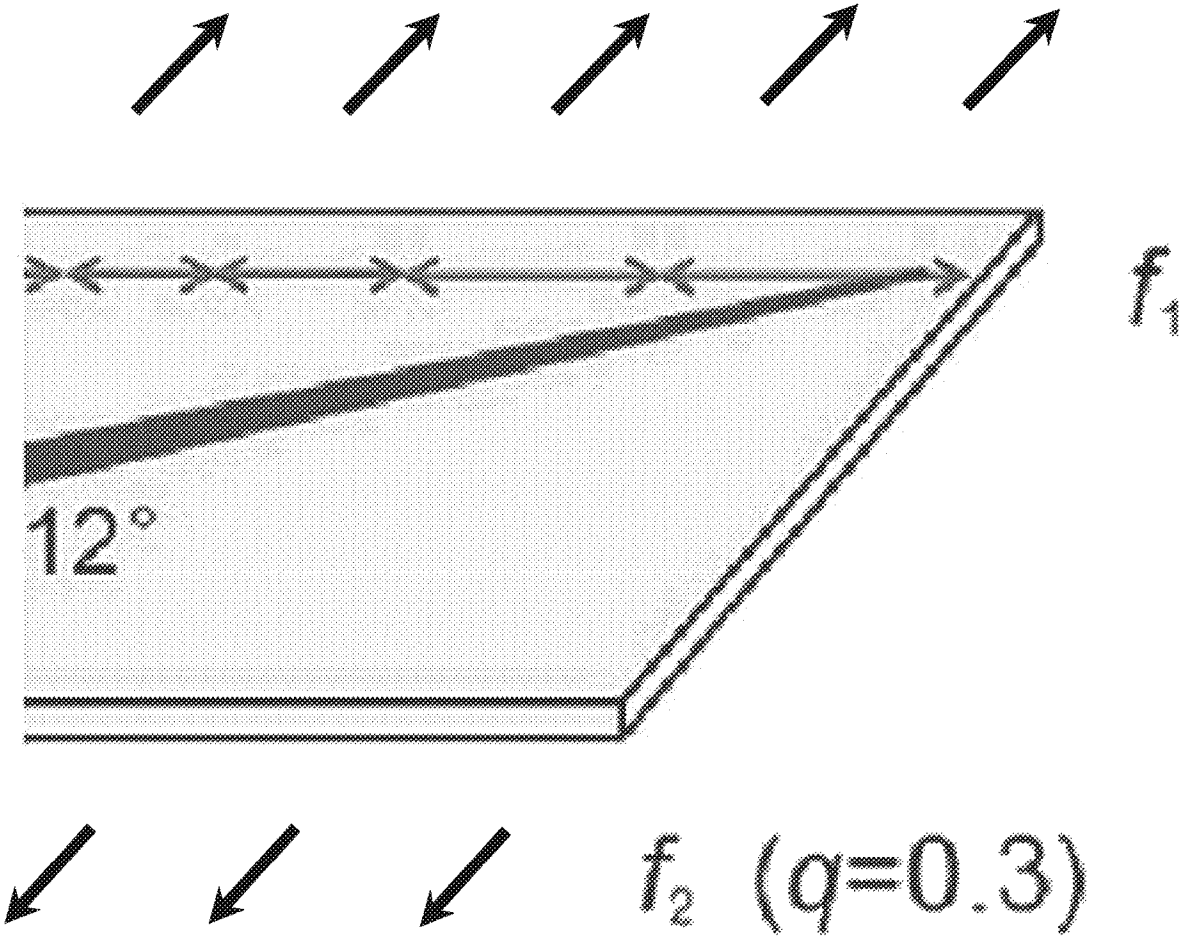
Figure 7:
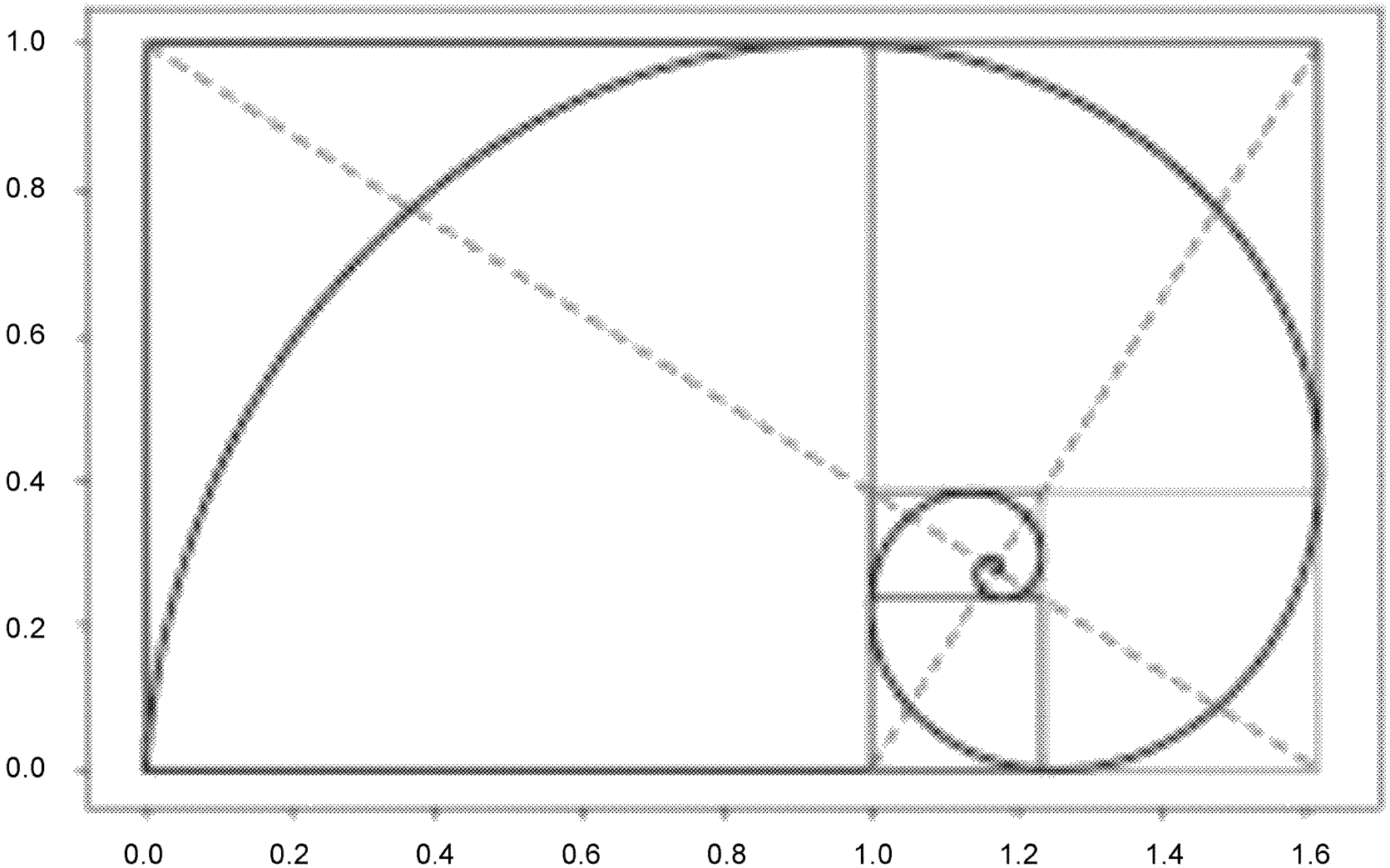
Figure 8:
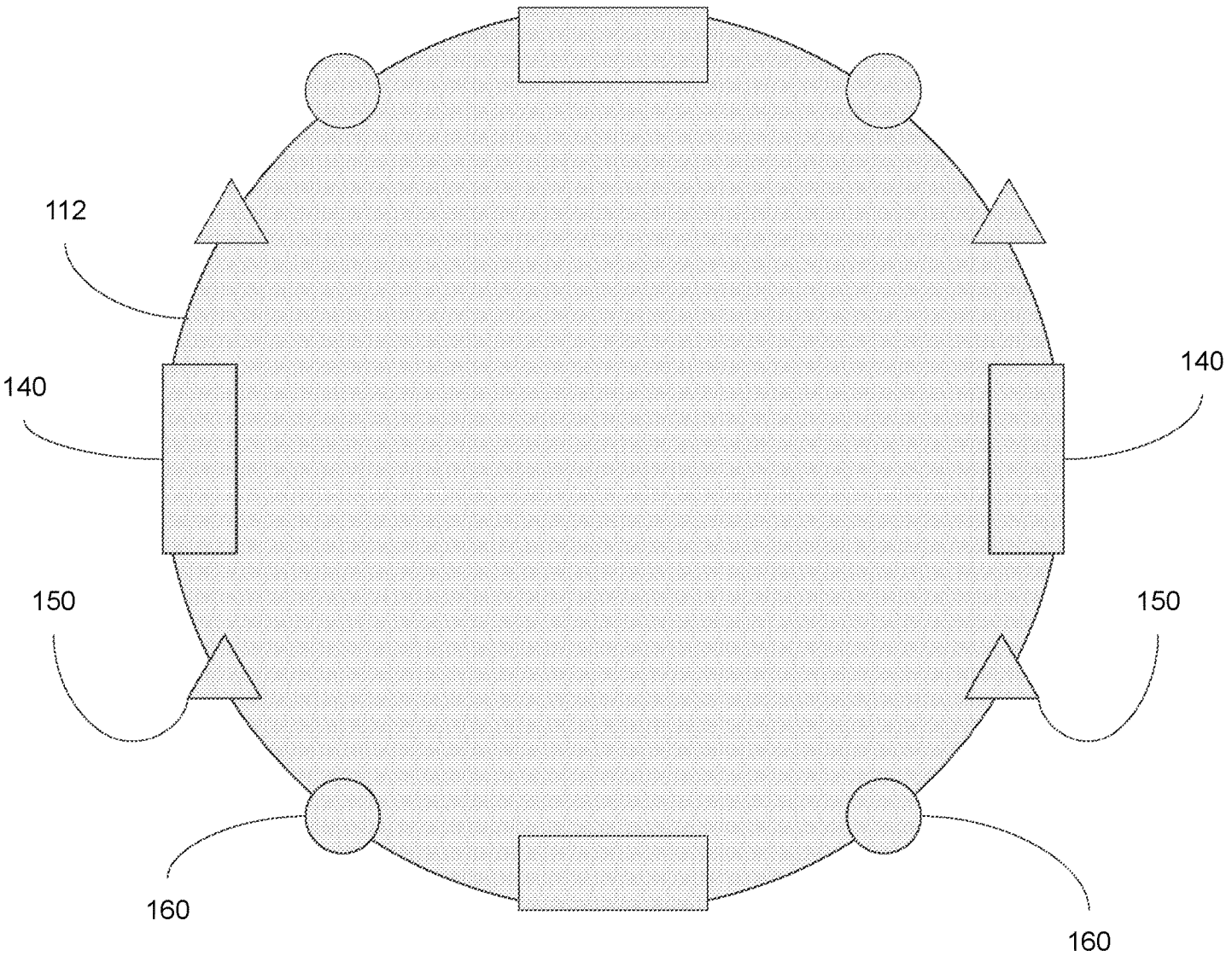

FIG. 8 shows a first end of the air pellet receptacle of the present invention having a plurality of motion sensors for activating a plurality of lights and speakers that are activated when an air pellet hits the target and passes through said target to trigger the motion sensors.

Figure 9:
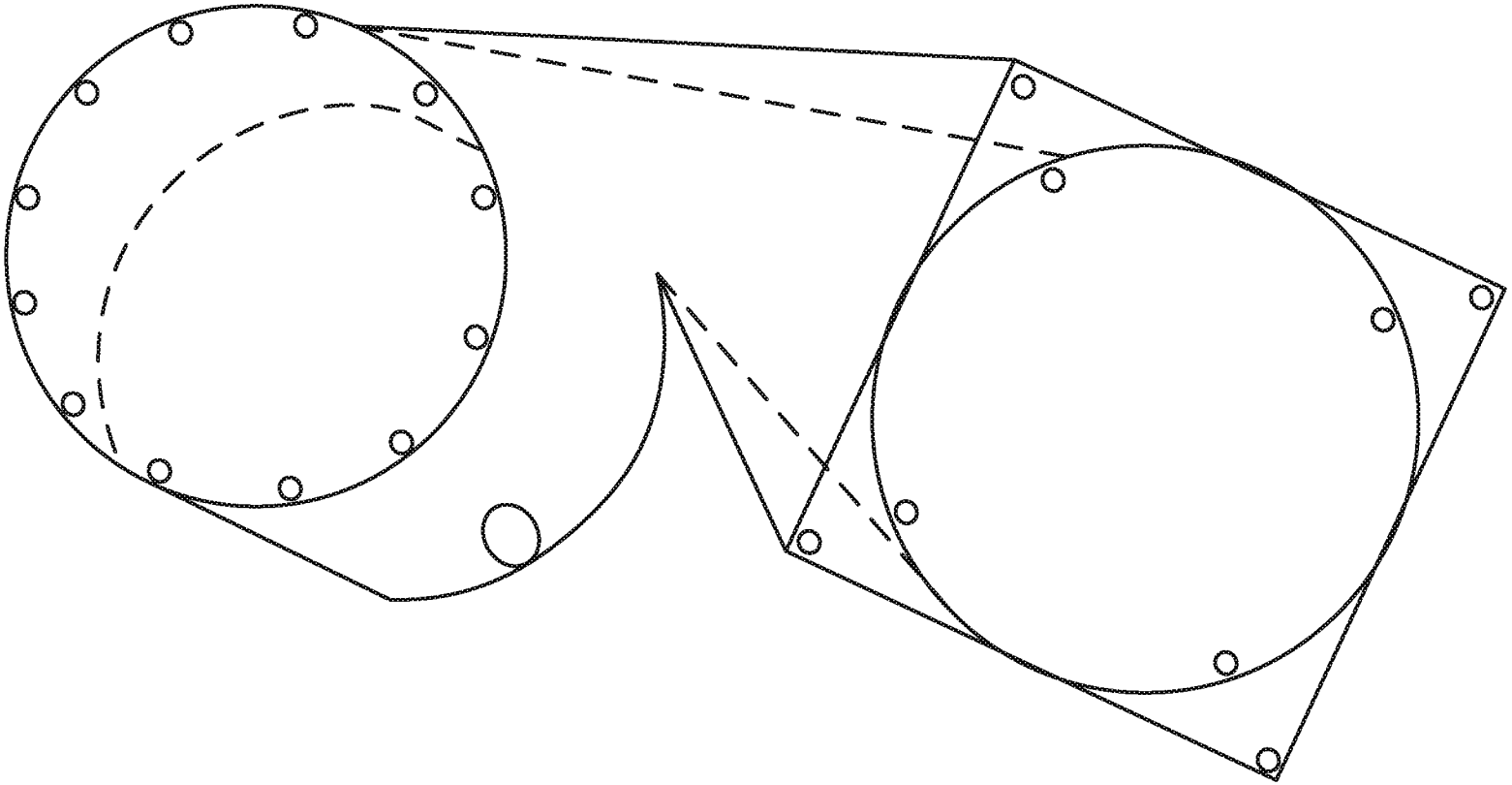

FIG. 9 shows an alternate embodiment of the air pellet receptacle of the present invention.

DETAILED DESCRIPTION OF THE INVENTION

Following is a list of elements corresponding to a particular element referred to herein:

100 device
110 hollow body
112 first end

114 second end
120 base component
122 collection chamber
130 penetrable target
140 motion sensors
150 LEDs
160 speakers Referring to the figures, in some embodiments, the present invention features an airsoft pellet receptacle device (100). In some embodiments, the device (100) may comprise a hollow body (110) having a tapered helical shape. The hollow body (110) may comprise a first opening at a first end (112) of the hollow body (110), and a second opening at a second end (114) of the hollow body (110). In some embodiments, a diameter of the hollow body (110) may decrease from the first end (112) to the second end (114). The hollow body (110) has a helical path or helical channel disposed therein, which connects the first opening to the second opening of the hollow body (110). Pellets are shot into the first opening, travel the helical path or helical channel, and exit the second opening.

In some embodiments, the device (100) may further comprise a base component (120) comprising a pellet inlet, a collection chamber (122), and a hollow path within the base component (120) connecting the pellet inlet to the collection chamber (122). In some embodiments, the second end (114) of the hollow body (110) may be coupled to the pellet inlet of the base component (120). Pellets shot into the first opening may travel down the length of the hollow body (110) and through the pellet inlet into the collection chamber (122) for retrieval.

In some embodiments, a material of the hollow body (110) comprises plastics, rubbers, fabrics, metals, foam, or a combination thereof. In some embodiments, the device (100) may further comprise a penetrable target (130) disposed at the first end (112) of the hollow body (110). In some embodiments, the penetrable target (130) may fully cover the first opening. The penetrable target (130) may comprise a sheet of material with a design (i.e. a bullseye). In some embodiments, the device (100) may further comprise one or more motion sensors (140) disposed at the first end (112) of the hollow body (110), behind the penetrable target (130).

In some embodiments, the device (100) may further comprise one or more light-emitting diodes (LEDs) (150) disposed on a surface of the hollow body (110), configured to emit light, communicatively coupled to the one or more motion sensors (140). Triggering the one or more motion sensors (140) may cause the one or more LEDs (150) to activate. In some embodiments, the device (100) may further comprise one or more speakers (160) disposed on a surface of the hollow body (110), configured to emit sound, communicatively coupled to the one or more motion sensors (140). Triggering the one or more motion sensors (140) may cause the one or more speakers (160) to activate. In some embodiments, the hollow body (110) may be magnetized by one or more magnets. The one or more magnets may comprise neodymium magnets.

An air-soft pellet collector/container/receptacle having a helical logarithmic vortical spiral "wormhole" shaped funnel, which appears to be curved or twisted in a conical shape. In some embodiments, this shape may be a spherical vortex wormhole having an optimal dynamic for moving pellets in a space, consisting of a region in a fluid/air and or space in which the flow rotates around an axis line. In some embodiments, the axis line may be straight or curved. In some embodiments, said space may comprise 2 axes continuously rotating in tandem in accordance with another rotational axis. In some embodiments, this rotational axis may be a straight line. In other embodiments, the rotational axis may also be curved to move pellets at an optimal level of ergonomics and aerodynamics. The optimal level of ergonomics and aerodynamics may be determined by mathematics such as Pi and/or Vortex Math (i.e. using simulation to estimate probabilities).

In some embodiments, the pellet receptacle may comprise a three-dimensional shape like that of a nautilus shell, comprising a single layer wound uniformly around a cylinder or cone, as in a corkscrew or spiral. In some embodiments, the shape may be designed by mathematically using Fibonacci's sequence to describe certain shapes that appear in nature. In some embodiments, the shapes may comprise logarithmic spirals, such as those found in the Family Turritellidae, commonly known as the turritellas, including true auger snails, tower snails, or screw snails. The tube-shaped shell of these snails has many whorls, or spirals, and is long and thin with a pointed end. These helical structures are ubiquitous and can be found in natural and engineered systems with nearly uniform radius and pitch. Helical shape structures with changing radius and pitch, such as seashells and some plant tendrils, add to the variety of this family.

In some embodiments, the pellet receptacle may comprise a "worm hole" shaped funnel, which appears to be a curved or twisted conical shape. A first end may form a circular opening with a target covering the opening such that air-soft pellets shot at the target are captured in the funnel. In some embodiments, a shape of the pellet trap may gradually narrow and follow a downward path that is curved or twisted. In some embodiments, the curved and twisted portion may be a part of a weighted base that holds the receptacle in a fixed position. In some embodiments, a lower end of the curved and twisted portion may comprise a collection chamber configured to collect pellets for reuse. The total potential energy of all pellets may be minimized everywhere when the system achieves an equilibrium.

In some embodiments, the penetrable target (130) may comprise a sheet of paper having a design printed on it. In some embodiments, the penetrable target (130) may comprise a sheet of fabric. In some embodiments, the sheet of fabric may comprise a plurality of openings sized and shaped to allow pellets to penetrate the target in only one direction (e.g. from outside of the receptacle inwards). In some embodiments, the sheet of fabric may be configured to block penetration of pellets in a direction (e.g. ricocheting from within the receptacle toward the opening). In some embodiments, the sheet of fabric may comprise multiple layers of fabric, much like the teeth/baleen of a whale. In some embodiments, pellets may be able to enter the hollow body (110) through the sheet of fabric, and the pellets may be prevented from exiting the hollow body (110) through the sheet of fabric.

In some embodiments, the penetrable target (130) may comprise a plurality of noodle-like strands of fabric, foam, any penetrable material, or a combination thereof. In some embodiments, the penetrable target (130) may comprise a plurality of strings comprising fabric, foam, any other penetrable material, or a combination thereof.

In some embodiments, the local energy minimization is a result of the geometric compatibility of the receptacle. Hence, the whole system may deform into a shape with a geometric energy minimum such that the energy in each pellet segment is locally optimized to dissipate as quickly as possible.

In some embodiments, the energy of pellets as they approach a wall of the receptacle can be applied with Pi math to develop materials and systems with desirable geometries by exploiting mechanics of geometric frustration and complications in movement to optimize a full stop of pellets. In some embodiments, the receptacle opening may comprise one or more motion sensors disposed behind the target. In some embodiments, the receptacle opening may further comprise one or more light-emitting diodes (LEDs) configured to light up in a plurality of colors and/or patterns, one or more speakers configured to emit sound (e.g. music, sound effects), or a combination thereof. The motion sensors may be operatively coupled to the one or more LEDs, the one or more speakers, or the combination thereof such that activation of the motion sensors by airsoft pellets shot through the target actuates the one or more LEDs, the one or more speakers, or the combination thereof.

In some embodiments, the receptacle may comprise one or more of many suitable materials including, plastics, rubbers, fabrics, metals, foam, Styrofoam®, or a combination thereof. In some embodiments, the receptacle may be magnetized with neodymium magnets for attracting iron pellets.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting essentially of" or "consisting of", and as such the written description requirement for claiming one or more embodiments of the present invention using the phrase "consisting essentially of" or "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. An airsoft pellet receptacle device (100) comprising:

a. a hollow body (110) having a tapered helical shape, the hollow body (110) comprising a first opening at a first end (112) of the hollow body (110), and a second opening at a second end (114) of the hollow body (110); wherein a diameter of the hollow body (110) decreases from the first end (112) to the second end (114); and b. a base component (120) comprising a pellet inlet, a collection chamber (122), and a hollow path within the base component (120) connecting the pellet inlet to the collection chamber (122);

wherein the second end (114) of the hollow body (110) is coupled to the pellet inlet of the base component (120).

2. The device (100) of claim 1, wherein a material of the hollow body (110) comprises plastics, rubbers, fabrics, metals, foam, or a combination thereof.

3. The device (100) of claim 1 further comprising a penetrable target (130) disposed at the first end (112) of the hollow body (110), wherein the penetrable target (130) fully covers the first opening.

4. The device (100) of claim 3, wherein the penetrable target (130) comprises paper.

5. The device (100) of claim 3, wherein the penetrable target (130) comprises a sheet of fabric comprising a plurality of openings, wherein the plurality of openings are shaped such that pellets are able to enter the hollow body (110) through the sheet of fabric, and the pellets are prevented from exiting the hollow body (110) through the sheet of fabric.

6. The device (100) of claim 3 further comprising one or more motion sensors (140) disposed at the first end (112) of the hollow body (110), behind the penetrable target (130).

7. The device (100) of claim 5 further comprising one or more light-emitting diodes (LEDs) (150) disposed on a surface of the hollow body (110), configured to emit light, communicatively coupled to the one or more motion sensors (140), wherein triggering the one or more motion sensors (140) causes the one or more LEDs (150) to activate.

8. The device (100) of claim 5 further comprising one or more speakers (160) disposed on a surface of the hollow body (110), configured to emit sound, communicatively coupled to the one or more motion sensors (140), wherein triggering the one or more motion sensors (140) causes the one or more speakers (160) to activate.

9. The device (100) of claim 1, wherein the hollow body (110) is magnetized by one or more magnets.

10. The device (100) of claim 8, wherein the one or more magnets comprise neodymium magnets.

11. The device (100) of claim 1, wherein the hollow body (110) has a helical path or helical channel disposed therein, wherein the helical path or helical channel connects the first opening to the second opening of the hollow body (110), wherein an airsoft pellet enters the first opening, travels the helical path or helical channel, and exits the second opening.

12. An airsoft pellet receptacle device (100) comprising:

a. a hollow body (110) having a tapered helical shape, the hollow body (110) comprising a first opening at a first end (112) of the hollow body (110), and a second opening at a second end (114) of the hollow body (110); wherein a diameter of the hollow body (110) decreases from the first end (112) to the second end (114);

b. a penetrable target (130) disposed at the first end (112) of the hollow body (110), wherein the penetrable target (130) fully covers the first opening;

c. one or more motion sensors (140) disposed at the first end (112) of the hollow body (110), behind the penetrable target (130);

d. one or more light-emitting diodes (LEDs) (150) disposed on a surface of the hollow body (110), configured to emit light, communicatively coupled to the one or more motion sensors (140), wherein triggering the one or more motion sensors (140) causes the one or more LEDs (150) to activate;

e. one or more speakers (160) disposed on a surface of the hollow body (110), configured to emit sound, communicatively coupled to the one or more motion sensors (140), wherein triggering the one or more motion sensors causes the one or more speakers (160) to activate; and f. a base component (120) comprising a pellet inlet, a collection chamber (122), and a hollow path within the base component (120) connecting the pellet inlet to the collection chamber (122);

wherein the second end (114) of the hollow body (110) is coupled to the pellet inlet of the base component (120).

13. The device (100) of claim 12, wherein a material of the hollow body (110) comprises plastics, rubbers, fabrics, metals, foam, or a combination thereof.

14. The device (100) of claim 12, wherein the penetrable target (130) comprises paper.

15. The device (100) of claim 12, wherein the hollow body (110) is magnetized by one or more magnets.

16. The device (100) of claim 15, wherein the one or more magnets comprise neodymium magnets.

17. The device (100) of claim 12, wherein the hollow body (110) has a helical path or helical channel disposed therein, wherein the helical path or helical channel connects the first opening to the second opening of the hollow body (110), wherein an airsoft pellet enters the first opening, travels the helical path or helical channel, and exits the second opening.

18. The device (100) of claim 12, wherein the penetrable target (130) comprises a sheet of fabric comprising a plurality of openings, wherein the plurality of openings are shaped such that pellets are able to enter the hollow body (110) through the sheet of fabric, and the pellets are prevented from exiting the hollow body (110) through the sheet of fabric.

* * * * *